United States Patent [19]

Braziel

[11] Patent Number: 4,498,221

[45] Date of Patent: Feb. 12, 1985

[54] APPARATUS FOR STRIPPING PACKAGED LINEAR MATERIAL FROM A FORMING TUBE

[75] Inventor: Jeffrey B. Braziel, Travelers Rest, S.C.

[73] Assignee: Owens-Corning Fiberglas Corporation, Toledo, Ohio

[21] Appl. No.: 523,801

[22] Filed: Aug. 16, 1983

[51] Int. Cl.[3] ..... B23Q 3/00

[52] U.S. Cl. ..... 29/283.5; 29/234; 29/426.5; 414/17; 242/68.5

[58] Field of Search ..... 414/17, 222, 749, 751, 414/711; 29/414, 419 R, 419 G, 426.4, 928, 234, 235, 426.5, 283.51; 28/292, 297, 298; 242/1, 68.5; 72/402, 403, 404, 48, 333

[56] References Cited

U.S. PATENT DOCUMENTS

| | | | |
|---|---|---|---|
| 2,825,962 | 3/1958 | Brown et al. | 72/404 X |
| 3,186,655 | 6/1965 | Huffington et al. | 414/749 X |
| 3,455,521 | 7/1969 | Cunningham et al. | 242/118.32 |
| 3,906,598 | 9/1975 | Hacker | 28/297 X |

FOREIGN PATENT DOCUMENTS

| | | | |
|---|---|---|---|
| 2915845 | 11/1979 | Fed. Rep. of Germany | 28/297 |
| 2079649 | 1/1982 | United Kingdom | 414/751 |

*Primary Examiner*—Carl E. Hall
*Assistant Examiner*—John T. Burtch
*Attorney, Agent, or Firm*—Ronald C. Hudgens; Philip R. Cloutier; Greg Dziegielewski

[57] ABSTRACT

The disclosure embraces a method of and apparatus for mechanically stripping linear material such as strands or groups of glass filaments or fibers from plastic forming tubes wherein the packages are defective, incomplete, or "break-out" packages. A defective, incomplete or "break-out" package is disposed at a stripping station at which a tube deforming or collapsing member is engaged with a forming tube package to collapse the package so that the strand on the collapsed forming tube is loose or is a loose hank. The collapsed or deformed forming tube is withdrawn from the stripping station and a stripper member is engaged with the loose strand or hank of strand which is stripped from the forming tube as the forming tube is moved away from the stripping station.

6 Claims, 6 Drawing Figures

APPARATUS FOR STRIPPING PACKAGED LINEAR MATERIAL FROM A FORMING TUBE

TECHNICAL FIELD

This invention relates to a method of and apparatus for removing linear material, such as strands or groups of glass filaments, from wound packages which packages are incomplete or the linear material on the package has become impaired so that further processing of the linear material is not practicable.

BACKGROUND ART

It has been conventional practice particularly in the manufacture of linear material such as strands or groups of glass filaments or fibers to attenuate fine streams of glass into filaments or fibers by winding a group or strand of the glass filaments into a package on a rotating forming tube. As the glass streams and the filaments attenuated therefrom are extremely fine, fracture of the streams or the fine filaments is likely to occur periodically rendering the wound package incomplete or the filaments defective. Such incomplete or defective packages of strands or filaments are referred to as "break-outs".

The forming tubes upon which the groups of filaments or strands are wound may be of paper or of thin-walled molded plastic or resinous material.

Heretofore it has been a practice for an operator to separate the incomplete or defective packages from the complete packages and utilize a hand-held knife or tool to sever the group or strand of filaments from an incomplete or defective package in order that the forming tube, whether paper or plastic, may be reused in forming another package. The manual operation of cutting the strands or groups of filaments from a break-out package is very tedious and time consuming and adds considerable labor cost to the production of complete packages.

DISCLOSURE OF THE INVENTION

The present invention pertains to a method of and apparatus for mechanically stripping a plastic or resinous forming tube of residual glass strand of filaments from an incomplete, defective or "break-out" package occurring during forming or fabrication processes whereby the plastic or resinous forming tube may be recycled or reused for winding packages of strands of filaments or linear material.

The invention involves a method and apparatus for mechanically deforming or collapsing a thin-walled forming tube of plastic material containing an incomplete or defective package of strand of filaments. The residual strand of filaments on the package renders the strand of filaments loose or in a loosened condition on the tube.

With the strand of filaments on the plastic tube in a loose hank or condition, the loosened strand of linear material is stripped from the deformed or collapsed plastic forming tube. The waste strands of filaments are conveyed away and sold or disposed of. The collapsed or deformed forming tube is conveyed away from the stripping station and is flexed to its circular cylindrical shape in condition for reuse or recycling for attenuating glass streams to filaments by winding a strand or group of filaments on the recycled plastic forming tube.

The invention provides for high speed removal of the hank of strand from a deformed or collapsed plastic forming tube with a substantial reduction in the cost of removing the waste strand or linear material from a flexible plastic or resinous forming tube.

It is preferred to provide a ram for transferring an incomplete plastic forming tube package from a conveyor to a stripping station, elevating the package at the stripping station, collapsing or deforming the plastic forming tube rendering the linear material in a loosened condition on the forming tube, withdrawing the collapsed or deformed forming tube while engaging the residual loosened hank of strand or linear material with a retaining or stripping member which strips the material from the plastic forming tube as the forming tube is withdrawn from the stripping station, the stripped material being conveyed away as waste material from the region of the stripping station.

The deformed stripped forming tube is reflexed to a circular cylindrical shape for reuse in collecting a strand or linear group of attenuated filaments in a conventional manner.

Further objects and advantages are within the scope of this invention such as relate to the arrangement, operation and function of the related elements of the structure, to various details of construction and to combinations of parts, elements per se, and to economies of manufacture and numerous other features as will be apparent from a consideration of the specification and drawings.

BRIEF DESCRIPTION OF THE DRAWINGS

The details of the invention will be described in connection with the accompanying drawings in which.

BEST MODE FOR CARRYING OUT THE INVENTION

The method and apparatus of the invention involve the steps of moving or conveying an incomplete or "break-out" package of linear material, such as a strand of glass filaments, on a plastic or resinous forming tube to a stripping station, supporting the package out of engagement with the ram or member, deforming or collapsing the incomplete "break-out" package of linear material, retracting the stripped plastic forming tube from the stripping station by the ram or member, and restoring the plastic forming tube to circular cylindrical form for reuse in packaging linear material such as a strand of glass filaments at a filament forming apparatus.

The method and apparatus of the invention involve deforming or collapsing the plastic forming tube of the package so that the linear material on the package is reduced to a loosened or hank condition whereby the plastic forming tube may be stripped of the linear material without severing the linear material which is collected and disposed of or sold as waste material.

The thin-walled resinous or plastic forming tubes in circular cylindrical shape are utilized at a glass filament forming facility for attenuating glass filaments from fine streams of glass from a stream feeder by winding a strand of the filaments upon a plastic forming tube. During such filament forming and winding operations, frequent breakages of the filaments occur resulting in an incomplete package or a "break-out" package which renders the package unsuitable for further processing to form textile materials and the like.

An operator selects the incomplete or defective packages for delivery to the apparatus of the invention to remove or strip the residual strand or linear material from a forming tube so that the forming tube may be reused in forming a subsequent package of the strand or linear material.

Figures 1, 2:
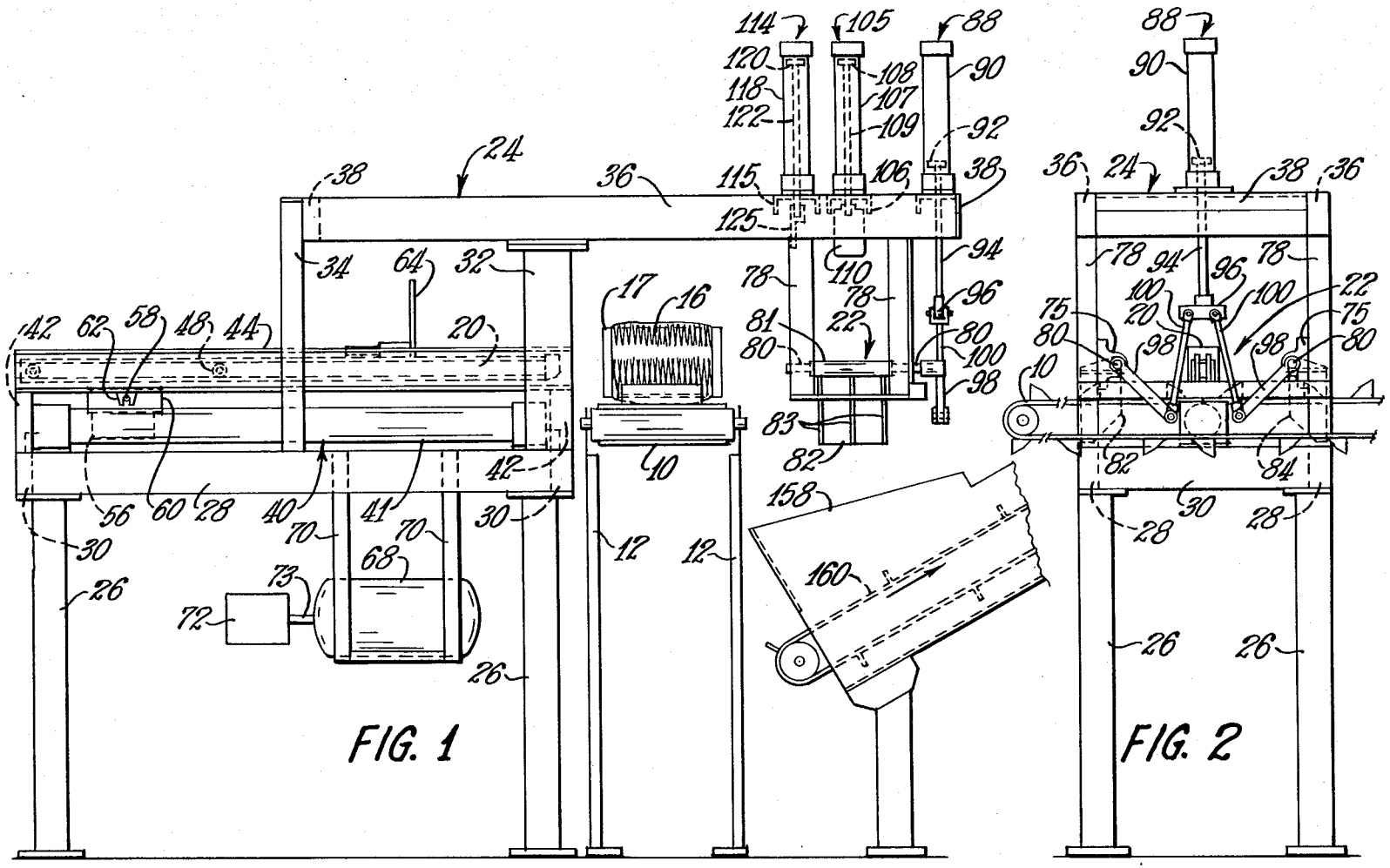
FIG. 1 is a side elevational view of a form of apparatus for stripping linear material from resinous or plastic forming tubes.
FIG. 2 is an end elevational view of the package deforming or collapsing means at the stripping station.

Referring initially to FIGS. 1 and 2, an endless conveyor 10 is mounted on supports 12 and the "break-out" or incomplete packages are delivered onto the conveyor 10. The conveyor 10 is of the type which is moved intermittently to bring a package 16 on a plastic forming tube 17 into a position whereby a ram or member 20 may be engaged with the package 16 for moving it to a stripping station 22.

The apparatus is inclusive of a frame structure 24 which supports the ram or member 20 and operative components at the stripping station hereinafter described. The frame structure 24 includes vertical post-like supports 26 on which are mounted longitudinally extending frame members 28 and transverse members 30. Supported upon the members 30 are pairs of members or posts 32 and 34. The posts 32 and 34 support longitudinally frame members 36 which are joined by transverse members 38.

Figure 4:
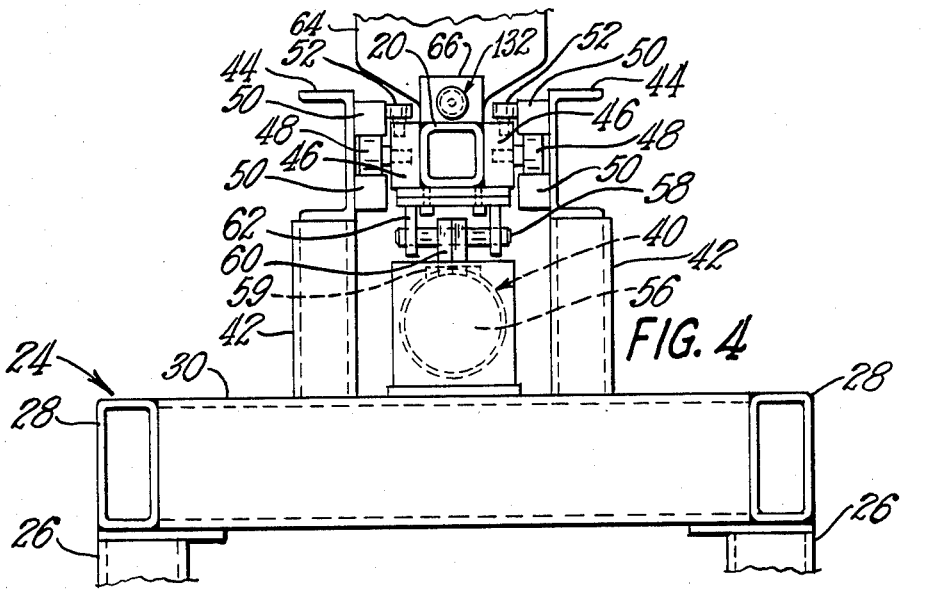
FIG. 4 is an end view of a portion of the apparatus of FIG. 1 illustrating a ram or member for moving a package into and away from the stripping station.

The members 28 and 30 provide support for the ram or member 20 and air actuator 40 which has an air cylinder 41. Mounted upon members 42 are lengthwise arranged channel members 44 shown in FIGS. 1 and 4. The ram or member 20 is mounted for lengthwise reciprocation and the mounting means for the ram 20 are illustrated in FIG. 4. Secured to the ram 20 are blocks 46 in which are journally supported rollers 48.

Secured to the channel members 44 are lengthwise arranged ways or tracks 50 which provide guide means for the rollers 48 carried by the blocks on ram member 20. Journaled in the guide members, ways or blocks 50 are rollers 52 which are guided by vertical surfaces of the upper pair of guide members 50 secured to the channel members 44. Thus the ram 20 is guided by rollers engaging the tracks or ways 50 so that a minimum of energy is required to reciprocate the ram or member 20.

Disposed in the air cylinder 40 is a free piston 56 and connected with the ram 20, as shown in FIG. 4, is a pin or stub shaft 58. The upper wall region of the air cylinder 40 has a lengthwise strip 59 of flexible material having a lengthwise slot therein. The air actuator 40 is adapted to receive air pressure for moving the piston 56 lengthwise of the cylinder 41.

The piston 56 is provided with a comparatively narrow member 60 which projects through the slot in the flexible member 59 at the upper portion of the cylinder 41. The member 60 is connected by a pin 58 with members of a yoke 62 secured to and depending from the ram 20. The air actuator 40 is of a rodless type cylinder in which the piston 56 actuated by air pressure in the air cylinder moves the member 60 in a slit in the flexible wall portion of the cylinder.

The air actuator of this type is made by the Origa Company of Elmhurst, Ill. As the ram 20 is connected with the piston 56 in the air cylinder 41, air under pressure alternately admitted to the ends of the air cylinder 41 will cause reciprocation of the piston 56 and ram or member 20.

Figure 5:
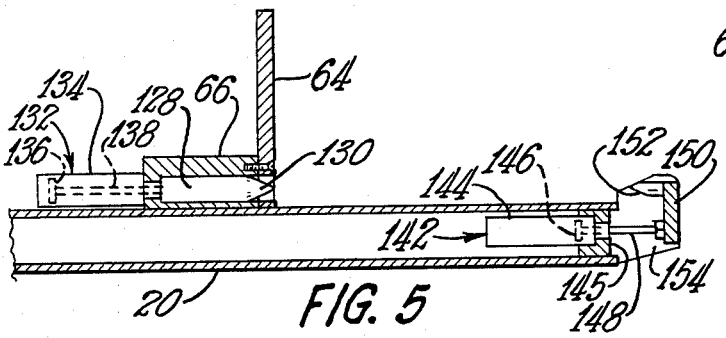
FIG. 5 is a longitudinal sectional view through a portion of the package conveying member or ram.
Figure 6:
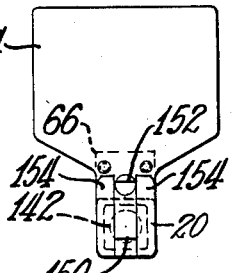
FIG. 6 is an end view of the ram or member shown in FIG. 5.

It will be noted from FIG. 1 that the path of reciprocation of the ram 20 is transverse to the conveyor 10. Mounted upon the ram or member 20 and shown in FIGS. 1, 5 and 6 is a member or abutment 64 which is secured to a member 66 which, in turn, is welded or secured to the ram 20. The purpose for the member 66 will be hereinafter explained.

It will be noted from FIG. 1 that movement of the ram or member 20 in a right-hand direction projects the ram through the hollow interior of the forming tube package 16 having a defective or an incomplete amount of linear material or strand.

Further movement of the ram 20 in a right-hand direction as viewed in FIG. 1 engages the abutment or member 64 carried by the ram 20 into engagement with the left-hand end of the forming tube 17 of the package 16 mounted on the conveyor 10 in alignment with the ram 20 and moves or positions the incomplete or "break-out" package 16 and its supporting tube 17 in a right-hand direction, as viewed in FIG. 1, into the stripping station 22.

The apparatus is inclusive of a pressure fluid or compressed air system for reciprocating the ram 20 and for actuating and controlling other mechanisms or instrumentalities of the stripper system. As shown in FIG. 1, a pressure tank or container 68 is supported from frame members 28 by support members 70 depending from the horizontal frame members 28.

An electrically operated motor driven pump 72 supplies air or other fluid under pressure through a pipe 73 into the container or tank 68. The electrically operated motor driven pump 72 may be controlled by a conventional pressure switch connected with the tank 68 for maintaining substantially constant fluid or air pressure in the tank.

The tube stripping station 22 has several mechanisms or instrumentalities for performing various functions in effecting removal of strand or linear material from a plastic forming tube of the character illustrated at 17.

When a plastic forming tube with residual or defective linear material thereon is disposed on the conveyor 10 in alignment with the ram 20, the ram 20 is actuated by fluid pressure in the left-hand end of the cylinder 41 against the piston 56 to move the ram 20 in a right-hand direction as viewed in FIG. 1.

The ram 20 enters the central hollow region of the forming tube 17 and when the ram is moved a predetermined distance in a right-hand direction the abutment 64 on the ram engages a left end of the forming tube 17. Right-hand movement of the ram 20 continues until the abutment 64 carried by the ram moves the forming tube 17 and the linear material thereon into the stripping station 22.

In this position the ram is brought to rest and extends into the stripping station 22. Means is provided at the stripping station 22 for elevating the forming tube 17 to a higher position wherein the ram 20 is disposed in the lower interior region of the forming tube 17.

Figure 3:
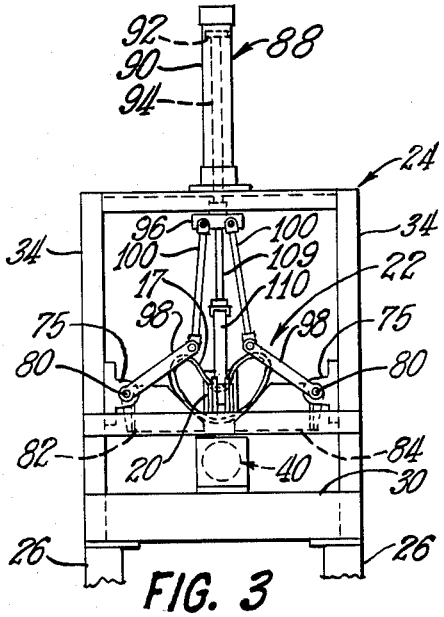
FIG. 3 is a view similar to FIG. 2 showing a forming tube package in deformed or collapsed position.

Referring to FIGS. 1, 2 and 3 brackets or support members 75 are secured to vertically disposed members 78 extending downwardly from the horizontal frame members 36. Journaled in each of the brackets 75 is a pin or stub shaft 80, each pin 80 being integral with a cross shaft 81.

One of the cross shafts 81 is fixedly secured to a means 82 and the other cross shaft 81 is fixedly secured to a second means 84. Disposed above the frame member 38 and mounted on the frame member is a fluid or air operated motor or actuator 88. The motor or actuator 88 comprises a cylinder 90 and a piston 92 within the cylinder and reciprocable therein.

Secured to the piston 92 is a piston rod 94 and connected to the lower end of the rod 94 is a yoke 96. Secured to and extending laterally from each of the members 81 is a crank arm or connector 98 and an end of each of the arms or connectors 98 is articulately connected by a link 100 with the yoke 96. The member or means 82 comprises three laterally spaced members or plates 83 which are fixedly secured to a cross shaft 81. The means 84 comprises three spaced plates similar to plates 83 secured to the other cross shaft 81.

When the mechanisms of the stripping station 22 are in the positions illustrated in FIG. 2, the piston 92 has been forced by air pressure in the cylinder 90 to its lowermost position as shown in FIG. 2, the links 100 are at their lowermost positions and the support means 82 comprising the transversely spaced plates 83 and the plates of support means 84 are disposed beneath each of the transverse or cross shafts 81 in the positions shown in FIG. 2 so that the means 82 and 84 are not in engagement with the linear material on the plastic forming tube 17 when the latter is first moved into position at the stripping station 22.

When the ram 20 moves the forming tube 17 with its residual linear material into position wherein the forming tube is in general alignment with the support plates 83 and the plates of means 84, the forming tube is in a position to be deformed or collapsed by the following described means or mechanism.

Disposed vertically at a mid region between the pairs of supports 78 in a parallel position with respect to the fluid motor or actuator 88 is a second fluid motor or actuator 105 supported on a frame member 106 which comprises a cylinder 107 in which is slidably mounted a piston 108 connected with a piston rod 109, the piston rod extending through the lower end of the cylinder 107 to which is secured a forming tube-collapsing or deforming means or member 110.

The forming tube-collapsing or deforming means 110 remains in elevated position as illustrated in FIG. 1 until the forming tube 17 is elevated by fluid pressure beneath the piston 92 in the cylinder 90 which forces the piston rod 94 and the yoke 96 upwardly.

As the yoke 96 moves upwardly, the links 100 are moved upwardly swinging the connecting links 98 about the axes of the pins 80 and thereby moving the means or sets of plates 82 and 84 upwardly to the position shown in FIG. 3 wherein the plates 83 of the means 82 and the assembly of plates of the means 84 are moved upwardly about the axes of the pins 80 thus engaging the plates of the support means 82 and 84 with the strand or linear material on the forming tube 17 and forcing the forming tube to its uppermost position wherein the ram 20 is then in a lower position interiorly of the forming tube as shown in FIG. 3.

With the support means 82 and 84 maintaining the forming tube 17 and the linear material thereon in an uppermost position, pressure fluid or compressed air is admitted to the upper end of the cylinder 107 above the piston 108 forcing the piston 108 and the rod 109 and the tube-collapsing or deforming member 110 downwardly.

The tube-collapsing or deforming member 110 exerts substantial force on the upper region of the forming tube 17, deforming or collapsing the upper region of the forming tube 17 downwardly as illustrated in FIG. 3 with the central portion of the collapsed tube 17 adjacent or in contact with the upper surface of the ram 20 as illustrated in FIG. 3.

The strand or linear material on the collapsed or deformed tube becomes loose or a loose hank of material on the collapsed or deformed tube 17. The loosened linear material or hank is now in a condition to be easily stripped from the deformed or collapsed plastic forming tube 17. The tube stripping arrangement as illustrated in FIG. 1 is inclusive of a fluid motor or actuator 114 supported upon a transverse frame member 115 mounted on frame members 36. The fluid motor or actuator 114 is inclusive of a cylinder 118 in which is a reciprocable piston 120 mounted on the upper end of a piston rod 122. Joined to the lower end of the piston rod exteriorly of the cylinder 114 is a stripper bar or member 125 which is secured to and depends from the piston rod as shown in FIG. 1.

At or about the time that the forming tube 17 is collapsed or deformed by the collapsing or deforming member 110 to the position shown in FIG. 3, the stripper bar or member 125 is forced downwardly by fluid pressure above the piston 120 in the cylinder 118 to its lowermost position adjacent and just above the collapsed or deformed region of the forming tube 17.

The lowermost position of the end of the stripper bar 125 is just slightly above the central depressed region of the forming tube so that a stripping operation may be performed to remove the loose hank of linear material on the collapsed forming tube by retracting the collapsed forming tube from the stripping station 22.

The collapsed or deformed forming tube at the stripping station is withdrawn from the stripping station by the ram 20, the stripper bar 125 in its lower position engaging the hank of loose linear material on the collapsed forming tube, the bar preventing movement of the loose hank of material with the retractive movement of the forming tube 17 so that the hank of loose material is stripped from the forming tube by withdrawing the forming tube out of the hank of loose material.

As the forming tube is withdrawn from the hank of loose material by the stripper, the stripped hank of material falls by gravity from the stripper station 22 into a hopper 158 onto a conveyor 160 shown in FIG. 1, the material being conveyed away as waste by the conveyor 160.

Means is associated with the ram 20 for gripping or locking the forming tube per se to the ram so that left-hand movement of the ram withdraws the forming tube, and the stripper 125 engages the loose hank of material and removes the hank of material from the forming tube during withdrawal by the ram.

Means is illustrated in FIG. 5 effective for clamping or gripping the collapsed forming tube 17 to the ram to move the stripped forming tube away from the stripping station. The means for clamping or latching the forming tube to the ram 20 during withdrawal of the forming tube from the stripping station are illustrated in FIG. 5. The abutment 64 on the ram 20 is secured to a cylinder 66 which is secured to the ram 20. Disposed in the cylinder 66 is a plunger 128 having a tapered or pointed end 130.

The cylinder 66 is secured to a fluid motor or actuator 132 comprising a cylinder 134 in which is disposed a piston 136 secured on a piston rod 138, the plunger 128 being secured to an end of the rod 138. The tapered end of the plunger 128 is adapted to engage and take over an edge of a deformed or collapsed region of the forming tube 17 when it is in the position shown in FIG. 3.

The right-hand end region of the ram 20 which is telescoped into the forming tube 17 is equipped with means for gripping an edge of the collapsed or deformed region of the tube 17, this arrangement being illustrated in FIG. 5. Disposed within the free end of the ram 20 is a fluid motor or actuator 142 which includes a cylinder 144 secured within the end region of the ram by a member 145.

Disposed in the cylinder 144 is a piston 146 secured on the end of a piston rod 148 which extends outwardly of the cylinder 144. Mounted on the outer end of the piston rod 148 is a member 150 which has a portion extending in a left-hand direction having a tapered end 152.

The adjacent end of the ram is provided with two parallel projecting portions 154 which form guides for guiding the member 150 and the tapered portion 152 when the piston 146 is moved in a left-hand direction which moves the tapered member 152 into locking or gripping engagement with the edge region at the same time that the tapered portion 130 of member 128 is moved in a right-hand direction whereby the tapered portions 130 and 152 engage end edge regions of the plastic forming tube 17.

The members 128 and 152 are engaged with the collapsed or deformed edge portions of the forming tube 17 before the plates of the support means 82 and the plates of the support means 84 are released by downward movement of the piston rod 94 in the cylinder 90.

Just before the support means 82 and 84 for the forming tube in the stripping station are released, the plunger 128 and member 150 are actuated toward one another to bring the tapered portions 130 and 152 into corresponding engagement with the edges of the collapsed or deformed plastic forming tube 17 on which the loose hank of strand or linear material is contained at the stripping station.

The stripper bar or member 125 which is rigidly secured to the piston rod 122 is moved by fluid pressure above the piston 120 downwardly wherein the stripper bar or member 125 extends into a position adjacent the gap in the upper region of the forming tube caused by collapsing or deforming the tube and in the path of the loose hank of strand or linear material on the tube at the stripping station.

Just before the time the support means 82 and 84 are moved away from engagement with the forming tube and the linear material thereon, the fluid motors or actuators 132 and 142 move the tapered forming tube gripping members 130 and 152 into gripping engagement with the forming tube.

After the forming tube 17 is gripped, latched or locked to the ram 20 by the tapered grip members 130 and 152, the stripping member 125 is moved by downward fluid pressure on the piston 120 to a position adjacent the collapsed or deformed region of the plastic forming tube 17. With the stripper member 125 in its lowermost position, the piston 56 connected to the ram 20 is actuated in a left-hand direction, as viewed in FIG. 1, by fluid pressure on the right side of the piston 56 thus withdrawing or moving the ram 20 and the plastic forming tube 17 gripped to the ram in a left-hand direction as viewed in FIG. 1.

As the collapsed or deformed plastic forming tube is moved by the ram 20 away from the stripping station 22, the loose hank of strand or linear material on the forming tube is engaged with the stripping member 125 and the forming tube thus moved out of the loose hank of strand or linear material stripping the hank from the forming tube.

The waste strand or linear material stripped from the forming tube falls into a hopper 158 which is provided with an endless belt conveyor 160. The loose material stripped from the forming tube falls onto the moving conveyor 160 and is conveyed away as waste.

The empty collapsed or deformed forming tube having been stripped of its strand or linear material is still clipped to the ram 20 and is conveyed by the ram onto the conveyor system 10 shown in FIG. 1. When the stripped forming tube is centered on the conveyor 10 or other support means, the fluid motors 132 and 142 receive fluid under pressure or compressed air in directions releasing the tapered gripping means 130 and 152 from engagement with the collapsed forming tube.

When the gripping members are released, the inherent flexibility of the collapsed or deformed forming tube is effective to substantially restore the forming tube to its circular cylindrical shape whereby it may be reused for collecting glass strand or other linear material into packages.

It is to be understood that the fluid motors or actuators may be operated by fluid under pressure, for example, compressed air contained in the pressure tank 68. The fluid pressure or compressed air system is inclusive of conventional valve means for controlling flow of pressure fluid or compressed air to the various fluid motors or actuators hereinbefore described. The compressed air system also has timing means or devices for sequentially actuating the valve means for controlling the flow of pressure fluid or compressed air to the fluid motors or actuators.

The method and apparatus of the invention are particularly usable for stripping linear material from forming tubes made of plastic or resinous material. Examples of the resinous material are polypropylene, acrylonitrile-butadiene-styrene (ABS), or similar resinous materials.

The forming tubes should be of relatively thin wall thickness so as to have the desired flexibility for collapsing or deforming the forming tube and for restoring the collapsed or deformed forming tube to a circular cylindrical shape for reuse. It is found that a forming tube having suitable flexibility may have a wall thickness of 0.057 inches or a wall thickness of 0.067 inches. The internal diameters of the forming tubes may be $6\frac{3}{8}$ths inches, 8 inches, or $11\frac{1}{4}$ inches and the average length of the forming tubes is about 11 inches.

The following is an enumeration in sequence of various method steps, operations or actions of various instrumentalities of the apparatus. The ram 20 is reciprocated by a rodless piston 56. On initial movement of the ram 20 in a right-hand direction, as viewed in FIG. 1, the ram is projected through the interior of the forming tube 17, and the abutment 64 is engaged with the left-hand end of the forming tube 17. Further movement of the ram 20 conveys the tube 17 and the linear material thereon into the forming station 22.

Withethe tube 17 and its linear material in place in the stripping station 22, the piston 94 of the actuator 88 is forced upwardly which, through the links 98 and 100 rotates the plates of the means 82 and 84 upwardly to the position shown in FIG. 3, elevating the forming tube 17 and the linear material carried by it.

The piston 108 of the actuator 105 is then forced downwardly with the member 110, the latter engaging the upper wall of the tube 17 to collapse or deform the tube to the position illustrated in FIG. 3. The support means 82 and 84 elevate the forming tube 17 so that the ram 20 is adjacent the depressed or deformed wall portion of the collapsed forming tube. The piston 120 in the cylinder 118 is forced downwardly moving the stripper bar or member 125 to its lowermost position adjacent the gap at the upper portion of the collapsed or deformed forming tube.

The members or plungers 128 and 150 having the pointed ends 130 and 152 respectively are actuated by the fluid motors 132 and 142 to move the pointed ends of members 130 and 152 into gripping, clamping or locking engagement with the edges of the collapsed forming tube 17.

With the pointed members 130 and 152 in engagement with the forming tube 17, the piston 56 of the actuator 40 is moved by fluid pressure in a left-hand direction as viewed in FIG. 1, moving the forming tube by itself past the stationary stripper member 125. The stripper bar or member engages and prevents the hank of loose material from moving with the forming tube 17 to thereby strip the hank of loose material off of the forming tube, the stripped material falling by gravity onto the conveyor 160 which conveys away the stripped material. The piston 56 continues to move the ram 20 and the forming tube 17 to the position on the conveyor 10.

When the empty collapsed forming tube 17 is in position on the conveyor 10, the pointed gripping members or plungers 128 and 150 in engagement with the forming tube are released so that the empty collapsed forming tube remains on the conveyor 10. When the members 130 and 152 are released the inherent flexibility of the plastic forming tube automatically causes the forming tube to snap into its circular cylindrical shape whereby the forming tube may thereafter be reused for forming packages of strand.

The piston 56 is then further moved by fluid pressure in a left-hand direction to move the ram 20 to its initial position shown in FIG. 1. In this manner "break-out" or defective packages of strand initially positioned on the conveyor 10 are successively stripped of loose hanks of strand without severing the strand or involving any operations on the part of an operator.

It is apparent that, within the scope of the invention, modifications and different arrangements may be made other than as herein disclosed, and the present disclosure is illustrative merely, the invention comprehending all variations thereof.

I claim:

1. Package stripping apparatus comprising, in combination, a package stripping station for stripping linear material from a plastic forming tube package, means supporting the forming tube package at the stripping station, means at the stripping station engageable with the package for collapsing the forming tube rendering the linear material in a loose hank on the collapsed forming tube, a stripper member, means for retracting the support means from the collapsed forming tube package at the stripping station, means for moving the collapsed forming tube away from the stripping station whereby the stripper member engages the loose hank of material on the collapsed forming tube for stripping the loose hank of material from the forming tube during movement of the forming tube away from the stripping station.

2. Package stripping apparatus according to claim 1 wherein the linear material on the forming tube is a strand of glass fibers.

3. Package stripping apparatus comprising, in combination, a package stripping station, a ram for advancing a package of linear material to the stripping station, said package comprising a forming tube bearing wound linear material, means at said stripping station to disengage the package from the ram, said means disengaging the package from the ram supporting the forming tube package at the stripping station, means at said stripping station engageable with the forming tube of the package for collapsing the forming tube rendering the linear material in a loose hank on the forming tube, a stripper bar adjacent the collapsed forming tube of the package, said ram being adapted to retract the forming tube from the stripping station, said stripper bar engaging the loose hank of material on the forming tube for stripping the loose hank of material from the forming tube during retraction of the ram.

4. Package stripping apparatus according to claim 3 wherein the means at the stripping station to disengage the package from the ram elevates the said package relative to the ram at the stripping station, the means at said stripping station for collapsing the forming tube at the stripping station being a member actuated by fluid pressure effective to collapse the forming tube, the ram having means engageable with the end edges of the collapsed forming tube at the stripper station, the ram being movable to retract the forming tube from the stripping station.

5. Package stripping apparatus according to claim 3, said means disengaging the package from the ram at the stripping station supporting the forming tube package in an elevated position, the ram for advancing the forming tube package having means engageable with the end edge regions of the collapsed forming tube whereby the ram is adapted to retract the forming tube from the stripping station, the said stripper bar engaging the loose hank of material on the forming tube for stripping the loose hank of material from the forming tube during retraction of the forming tube from the stripper station.

6. Package stripping apparatus comprising, in combination, a frame structure, a stripping station, conveyor means for supporting packages of linear material on plastic forming tubes, a ram supported by the frame structure, said ram being lengthwise reciprocable, means for reciprocating the ram, said ram being movable in one direction for engaging a package on the conveyor and transferring the package to the stripping station, means at said stripping station engageable with the package for elevating the package and supporting the package at the stripping station, means at said stripping station engageable with the forming tube package for collapsing the forming tube package rendering the linear material on the forming tube as a loose hank, stripper means movable to a position adjacent an end region of the collapsed forming tube of the package, the ram having clamp means engageable with the ends of the collapsed forming tube, said ram being movable in a direction for withdrawing the forming tube from the stripper station, the stripper means engaging the hank of loose material as the forming tube is withdrawn from the stripping station whereby the loose hank of linear material on the package is stripped from the forming tube.

* * * * *